US006026772A

United States Patent [19]

Shirabe

[11] Patent Number: 6,026,772

[45] Date of Patent: Feb. 22, 2000

[54] VALVE CHARACTERISTIC CONTROL APPARATUS FOR INTERNAL COMBUSTION ENGINE

[75] Inventor: Takeo Shirabe, Gotenba, Japan

[73] Assignee: Toyota Jidosha Kabushiki Kaisha, Aichi-ken, Japan

[21] Appl. No.: 09/210,351

[22] Filed: Dec. 11, 1998

[30] Foreign Application Priority Data

Dec. 17, 1997 [JP] Japan ..... 9-348252

[51] Int. Cl.[7] ..... F01L 1/344; F02D 13/02

[52] U.S. Cl. ..... 123/90.17; 123/90.31; 123/90.34

[58] Field of Search ..... 123/90.15, 90.16, 123/90.17, 90.18, 90.31, 90.33, 90.34

[56] References Cited

U.S. PATENT DOCUMENTS

| | | | |
|---|---|---|---|
| 5,540,197 | 7/1996 | Golovatai-Schmidt et al. | 123/90.17 |
| 5,566,651 | 10/1996 | Strauss et al. | 123/90.17 |
| 5,628,286 | 5/1997 | Kato et al. | 123/90.15 |
| 5,765,518 | 6/1998 | Nakano | 123/90.17 |
| 5,799,631 | 9/1998 | Nakamura | 123/90.17 |
| 5,803,031 | 9/1998 | Moriya | 123/90.17 |

FOREIGN PATENT DOCUMENTS 8-246818 9/1996 Japan .

8-326512 12/1996 Japan .

*Primary Examiner*—Weilun Lo

*Attorney, Agent, or Firm*—Kenyon & Kenyon

[57] ABSTRACT

A valve characteristic control apparatus for controlling the operation characteristics of the valves of an internal combustion engine driven by a camshaft is disclosed. A working oil supply control valve is arranged in a support member for supporting the camshaft. A first oil path and a second oil path for leading the working oil from the working oil supply control valve to the first and the second oil chambers include an annular first oil path and an annular second oil path formed in the camshaft and the slide portion of the support member for pivotally supporting the camshaft, a first and a second in-support member oil path for connecting the annular first oil path and the working oil supply control valve and for connecting the annular second oil path and the working oil supply control valve. A bearing metal is arranged between the annular oil paths and the cam-side openings of the in-support member oil paths, and at least one of the in-support member oil paths, after reaching the back of the metal bearing from the working oil supply control valve, extends in an axial direction along the back of the bearing metal and communicates with a corresponding annular oil path at a different axial position from the back point reached by the same in-support member oil path.

8 Claims, 11 Drawing Sheets

VALVE CHARACTERISTIC CONTROL APPARATUS FOR INTERNAL COMBUSTION ENGINE

BACKGROUND OF THE INVENTION

1. Field of the Invention

The present invention relates to a valve characteristic control apparatus or, in particular, to a configuration of the oil paths of a valve characteristic control apparatus for changing valve characteristics by displacing a camshaft by oil pressure.

2. Description of the Related Art

The valve characteristic control apparatuses for changing valve characteristics are roughly divided into two types. One changes the valve open period itself and the other shifts the valve open period without changing the valve open period. In the former type, the camshaft is moved in axial direction in many cases. The latter type, on the other hand, is often achieved by means of changing the rotational phase of the camshaft with respect to the crankshaft and camshaft is moved by oil pressure in most cases.

An example of the latter type is a valve characteristic control apparatus disclosed in JP-A-8-326515. This apparatus comprises an advance oil chamber formed between a pulley and a camshaft for changing the rotational phase of the camshaft in such a manner as to shift the valve operation phase to the advance side when the working oil is supplied thereto, and a retard oil chamber for changing the rotational phase of the camshaft in such a manner as to shift the valve operation phase to the retard side when the working oil is supplied thereto, wherein the working oil is supplied to the advance oil chamber and the retard oil chamber from a working oil supply control valve arranged in a support member for supporting the camshaft.

The working oil is supplied to the camshaft and an annular advance oil path and an annular retard oil path formed in a sliding portion of the support member for pivotally supporting the cam shaft through the advance oil path and the retard path formed in the pivot member. From the annular advance oil path and the annular retard oil path, the working oil is introduced through another advance oil path and another retard oil path formed in the camshaft to the advance oil chamber and the retard oil chamber, respectively.

The advance oil path in the pivot member and the annular advance oil path communicate directly with each other, and so do the retard oil path in the support member and the annular retard oil path. Therefore, the advance oil path in the support member and the retard oil path in the support member are required to be spaced from each other. As a result, the distance between the annular advance oil path and the annular retard oil path is also increased. The axial length of the engine is thus increased, thereby posing the problem of a deteriorated mountability and an increased weight of the engine.

JP-A-8-246818 also discloses same type of valve characteristic control apparatus. One embodiment shown in JP-A-8-246818 has an angled in-support-member retard oil path which requires complex machining. In other embodiments an in-support-member retard oil path is made as a groove on a bearing cap for easier machining. However, in these embodiments sufficient sealing is not obtained because of a small gap between the groove and an annular advance oil path on a cam shaft. Therefore, a bearing with a larger width or with a larger flange is required for a sufficient sealing.

This problem is not limited to the valve characteristic control apparatus of the phase-shift type, but is also shared by any valve characteristic control apparatus having the same structure for supply and discharge of the working oil.

SUMMARY OF THE INVENTION

In view of the above-mentioned problem, the object of the present invention is to provide a valve characteristics control apparatus which does not increase the axial length of the engine.

According to the present invention, there is provided a valve characteristic control apparatus for controlling the valve operation characteristics of an internal combustion engine, with valves opened and closed by the camshaft, comprising:

a first oil chamber for generating a force for displacing the camshaft to a first direction when supplied with the working oil;

a second oil chamber for generating a force for displacing the camshaft to a second direction opposite to the first direction when supplied with the working oil;

a working oil supply control valve arranged in a support member for supporting the camshaft for controlling the working oil supplied to the first oil chamber and the second oil chamber, the working oil being discharged from the second oil chamber when it is supplied to the first oil chamber, the working oil being discharged from the first oil chamber when it is supplied to the second oil chamber; and a first oil path for leading the working oil from the working oil supply control valve to the first oil chamber and a second oil path for leading the working oil from the working oil supply control valve to the second oil chamber;

wherein the first oil path and the second oil path include an annular first oil path and an annular second oil path formed in the camshaft and the slide portion of the support member for pivotally supporting the camshaft, a first oil path formed in the camshaft for connecting the annular first oil path and the first oil chamber, and a second oil path formed in the camshaft for connecting the annular second oil path and the second oil chamber, and another first oil path formed in the support member for connecting the annular first oil path and the working oil supply control valve and another second oil path formed in the support member for connecting the annular second oil path and the working oil supply control valve; and wherein a metal bearing is arranged between the annular oil paths and the cam-side opening of the oil paths in the support member, and at least one of the oil paths in the support member, after reaching the back of the bearing metal from the working oil supply control valve, communicates with a corresponding annular oil path at a different axial position from the back point reached by the oil path, through a back oil path extending in an axial direction along the back of the metal bearing.

The present invention may be made more fully understood from the description of preferred embodiments of the invention set forth below, together with the accompanying drawings.

DESCRIPTION OF THE PREFERRED EMBODIMENTS

Figure 1:
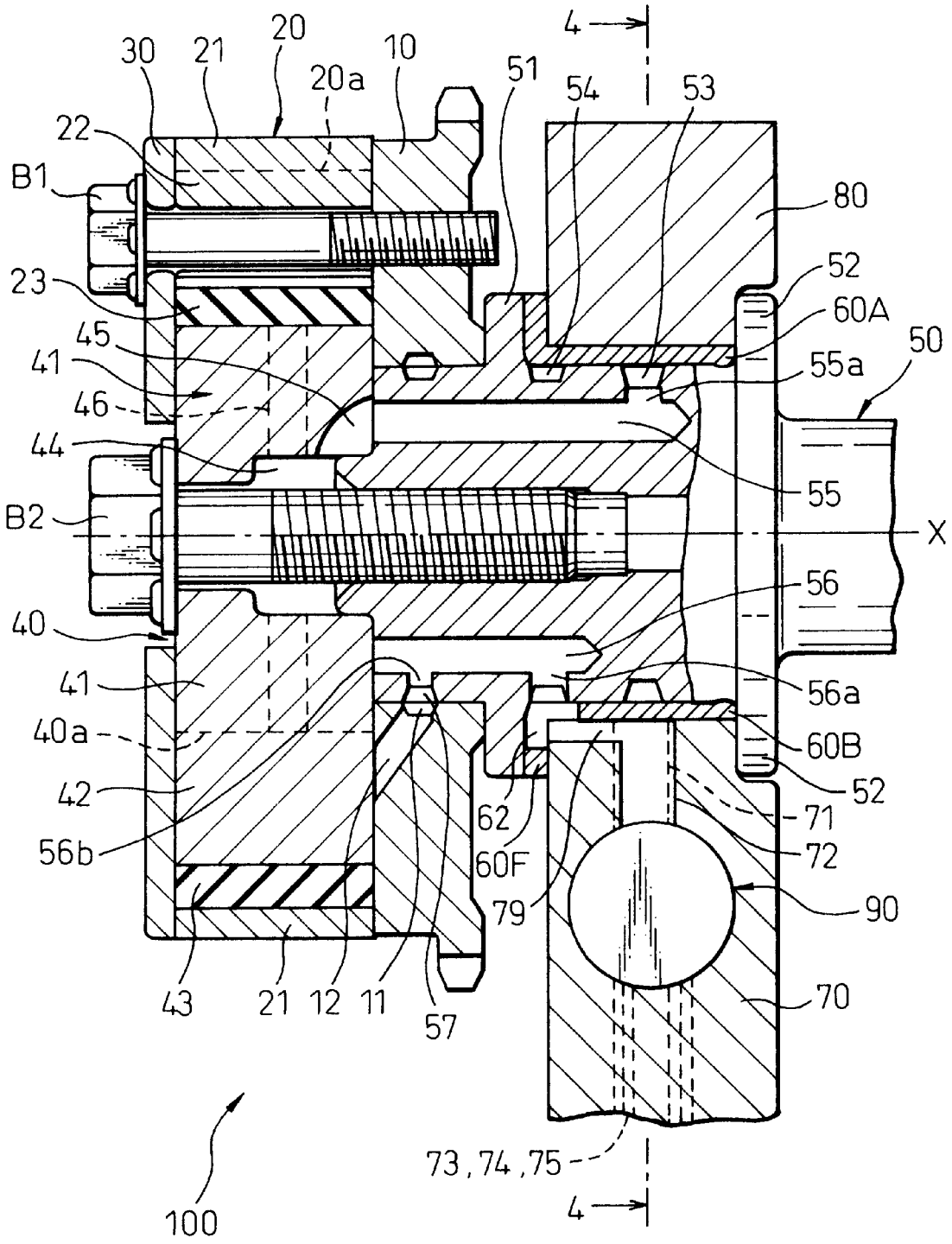
FIG. 1 is a sectional view of the structure of a valve timing control unit taken along the plane passing through the center axis of a cam.

FIG. 1 is a sectional view of a characteristic control apparatus 100, taken in a plane containing the center axis X of the camshaft 50, for a vane-type valve according to a first embodiment of the invention mounted on the camshaft for opening/closing the intake valve of an engine (not shown).

With reference to FIG. 1, a housing 20 and a side cover 30 forming an advance oil chamber 110 and a retard oil chamber 120 in cooperation with a gear 10 driven at a rotational ratio of ½ through a chain (not shown) by the crankshaft (not shown) are fixed on the gear 10 by bolts B1 (only one of four bolts is shown). A rotor 40 is arranged rotatably to a predetermined angle inside the housing 20. The rotor 40 is fixed by a bolt B2 on the camshaft 50.

Figure 2:
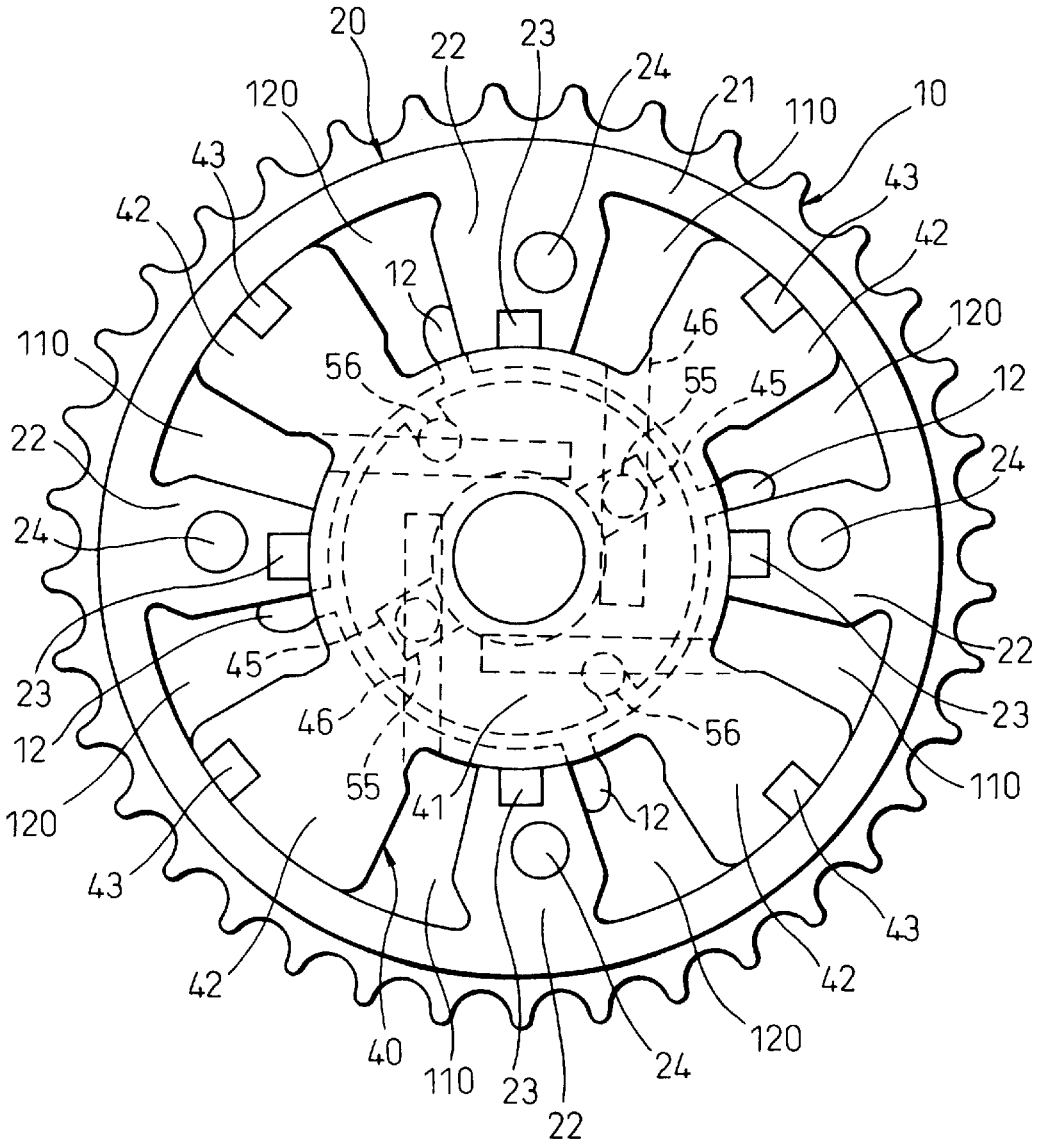
FIG. 2 is a diagram showing the unit of FIG. 1 as viewed along the axis.

FIG. 2 is a diagram showing the valve characteristic control apparatus 1 as viewed from the axial end (left side in FIG. 1) with the side cover 30 and the bolts B1, B2 removed.

As shown in FIG. 2, the housing 20 includes an outer peripheral portion 21 and four inner protrusions 22. Seal members 23 are arranged on the inner periphery of the inner protrusions 22. Numeral 24 designates holes through which the bolts B1 are applied. In FIG. 1, the portion of the housing 20 above the center axis X of the camshaft 50 is shown with the outer peripheral portion 21 and the inner protrusions 22 integrally with the seal members 23. The portion of the housing 20 below the center axis X of the camshaft 50, on the other hand, is shown with the outer peripheral portion 21. The dashed line 20*a* designates the boundary between the outer peripheral portion 21 and the inner protrusions 22.

The rotor 40 includes a boss 41 and four vanes 42 protruded radially outward from the boss 41. A seal member 41 is arranged on the outer periphery of the vanes. In FIG. 1, only the boss 41 of the rotor 40 is shown above the center axis X of the camshaft 50, while the boss 41 and the vanes 42 are shown integral with the seal member 43 under the center axis X of the camshaft 50. The dashed line 40*a* designates the boundary between the boss 41 and the vanes 42.

The boss 41 is formed with two inclined oil paths 45 for introducing the working oil from the advance oil path 55 in the camshaft to a central oil chamber 44 around the bolt B2 at the central portion of the boss 41 at the time of advance on the one hand and four distribution oil paths 46 for introducing the working oil from the central oil chamber 44 into the advance oil chamber 110 between the vanes 42 of the rotor 40 and the inner protrusions 22 of the housing 20.

Again referring to FIG. 1, the camshaft 50 is rotatably supported on a cylinder head 70 and a cam cap 80 through a half upper metal bearing 60A and a half lower metal bearing 60B between an outer flange 51 and an inner flange 52. Between the outer flange 51 and the inner flange 52, the annular advance oil path 53 is formed nearer to the inner flange 52, and the annular retard oil path is formed nearer to the outer flange 52.

The annular advance oil path 53 communicates through a short oil path 55*a* with the advance oil path 55 formed in the camshaft in parallel to the center axis X. The advance oil path 55 in the camshaft communicates with the inclined oil path 45 of the rotor 40.

The annular retard oil path 54 communicates through a short oil path 56*a* with the retard oil path 56 formed in the camshaft in parallel to the center axis X. The advance oil path 56 in the camshaft communicates with the annular retard oil path 57 formed nearer to the axial end than to the outer flange 51.

The annular retard oil path 57 at the axial end communicates with the retard oil chamber 120 through an in-gear distribution oil path 12 and an in-gear annular oil path 11 formed on the inner periphery of the gear 10 (FIG. 2).

Figure 3:
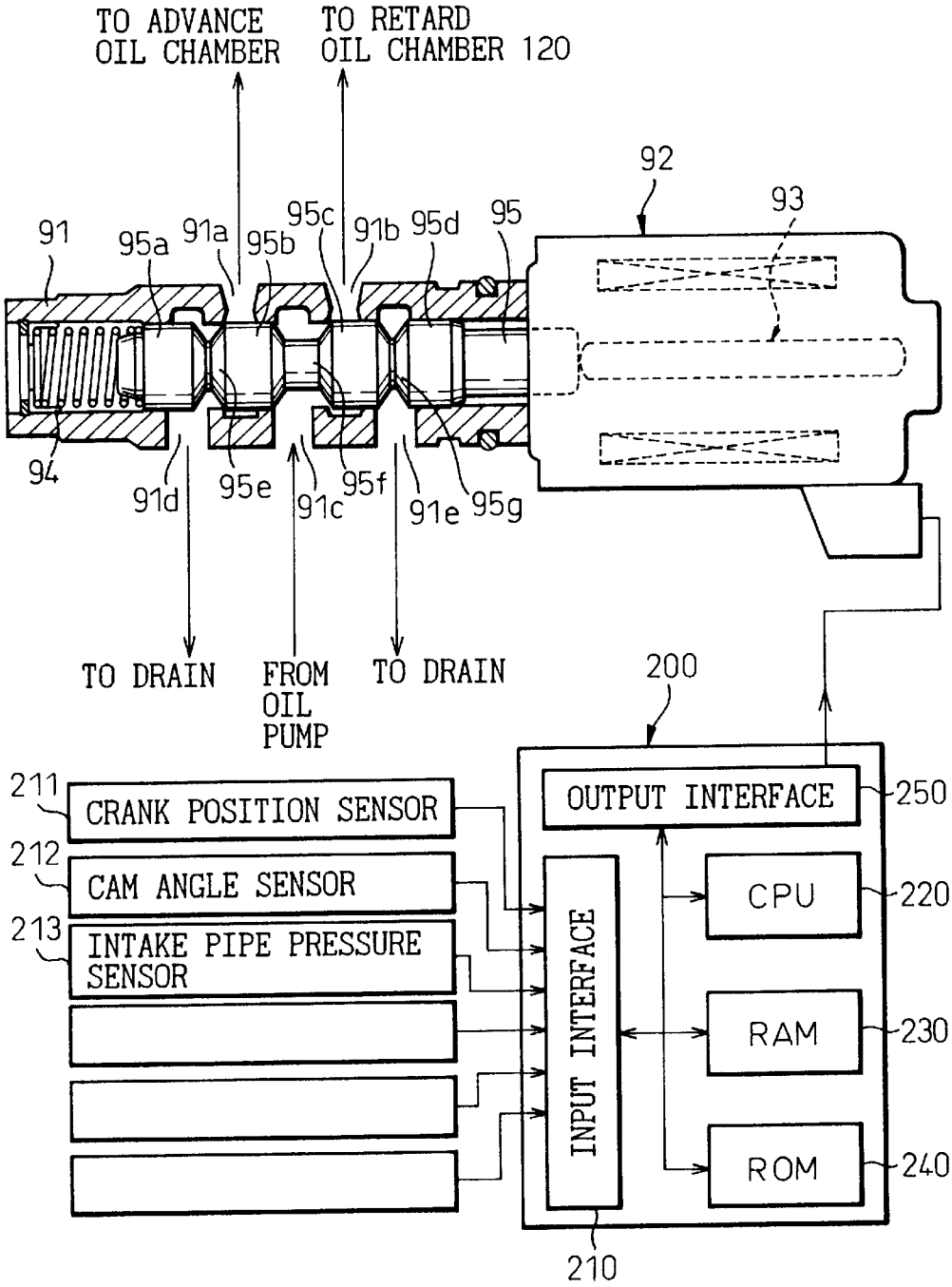
FIG. 3 is a diagram showing the structure of an oil control valve 90.

The cylinder head 70, on the other hand, is fitted with an oil control valve 90 for controlling the supply of the working oil to each oil chamber. FIG. 3 shows the oil control valve 90 in detail. As shown in FIG. 3, the oil control valve 90 operates in such a way that a spool valve 95 is moved by a spring 94 and a plunger 93 of an electromagnetic solenoid 92 in a sleeve 91 thereby to change the direction of flow of the working oil.

The sleeve 91 includes an advance port 91*a*, a retard port 91*b*, a supply port 91*c*, and drain ports 91*d*, 91*e*. The spool valve 95, on the other hand, includes four lands 95*a*, 95*b*, 95*c*, 95*d* and three groove paths 95*e*, 95*f*, 95*g*.

The electromagnetic solenoid 92 is energized by the duty-cycle operation of the signal from an electronic control unit (ECU) 200. By changing the duty cycle of the signal, the position of the spool valve 95 is changed to control the supply and discharge of the working oil to and from the advance oil chamber 110 and the retard oil chamber 120.

Assume, for example, that the electromagnetic solenoid 92 is energized at a duty cycle of 100%. The spool valve 95 moves to the extreme left, and the advance port 91*a* comes to communicate with the supply port 91*c*, and the retard port 91*b* comes to communicate with the drain port 91*e*. Thus, the working oil is supplied toward the advance oil chamber 110 of the valve characteristic control apparatus 100, so that the camshaft 50 is moved in the advance direction of the crankshaft.

With the duty cycle of 0% (not energized), the spool valve 95 moves to the extreme right, and the supply port 91*c* comes to communicate with the retard port 91*b*, and the advance port 91*a* with the drain port 91*d*. Also, the working oil is supplied toward the advance oil chamber 120 of the valve characteristics control apparatus 1, so that the camshaft 50 moves in the retard direction with respect to the crankshaft. FIG. 3 shows the communication between the supply port 91*c* and the retard port 91*b*.

As described later, a cam angle sensor 212 detects the phase difference of the camshaft 50 with respect to the crankshaft. When a predetermined phase difference is reached, the electromagnetic solenoid 92 is energized with an intermediate duty cycle. Then, the spool valve 95 stops at such a position as to cut off, by means of the lands 95*a*, 95*b*, 95*c*, 95*d*, the communication between the advance port 91*a*, the supply port 91*c* and the drain port 91*d* on the one hand and between the retard port 91*b*, the supply port 91*c* and the drain port 91*d* on the other hand. As a result, the camshaft 50 maintains the prevailing phase difference with the crankshaft.

Returning to FIG. 1, numeral 71 designates an advance oil path in the cylinder head for establishing communication between the advance port 91*a* of the oil control valve 90 and the annular advance oil path 53 formed in the camshaft 50. Also, numeral 72 designates a retard oil path in the cylinder head for establishing communication between the retard port 91*b* of the oil control valve 90 and the annular retard oil path 54 formed in the camshaft 50.

In similar fashion, in FIG. 1, numeral 73 designates a supply oil path for establishing communication between the supply port 91*c* of the oil control valve 90 and an oil pump (not shown), and numerals 74, 75 drain oil paths for establishing communication between the drain ports 91*d*, 91*e* of the oil control valve 90 and an oil pan.

Figure 4:
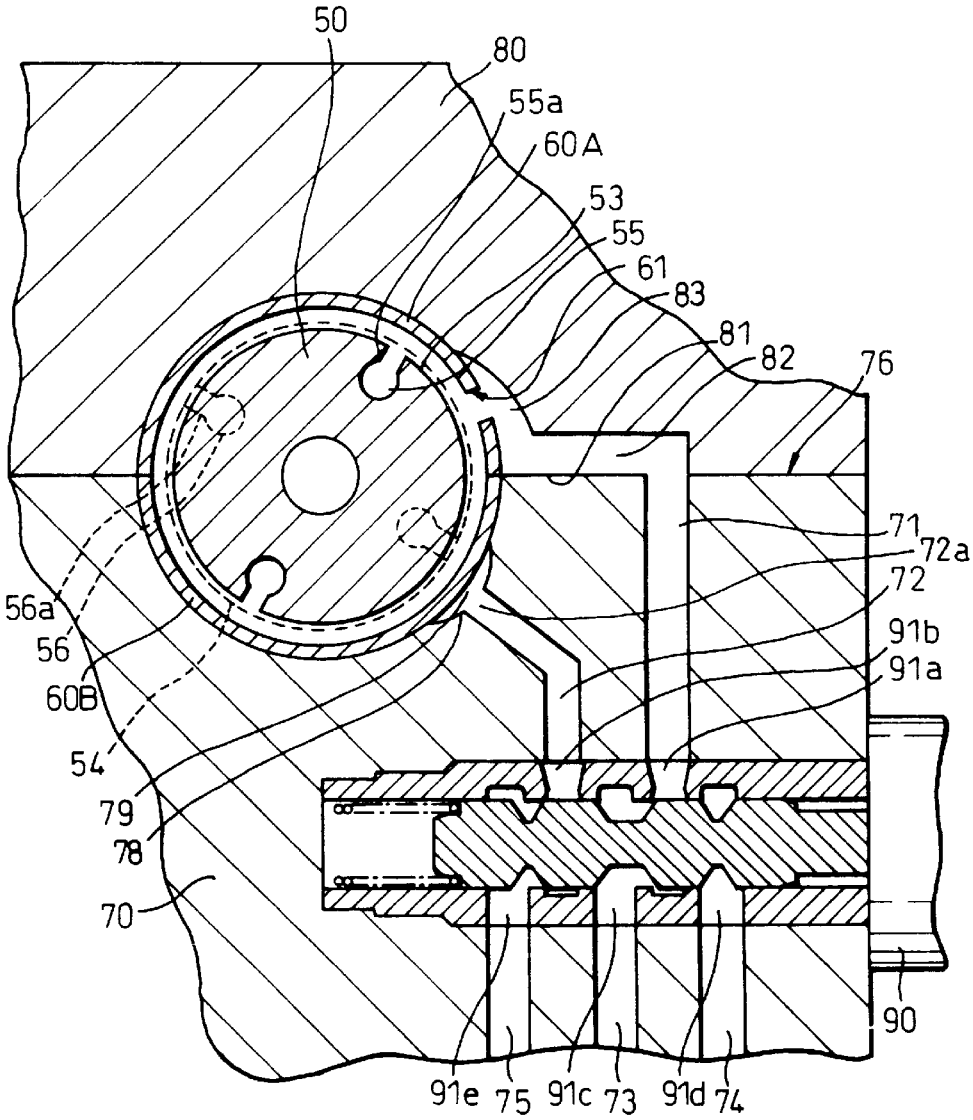
FIG. 4 is a sectional view taken in line 4—4 in FIG. 1 showing the communication between the internal oil paths of the oil control valve 90 and the camshaft 50.

FIG. 4 is a sectional view taken in line 4—4 in FIG. 1, and shows the communication between the annular advance oil path 53 and the advance oil path 71 in the cylinder head, and the communication between the annular retard oil path 54 and the retard oil path 72 in the cylinder head.

Figure 5:
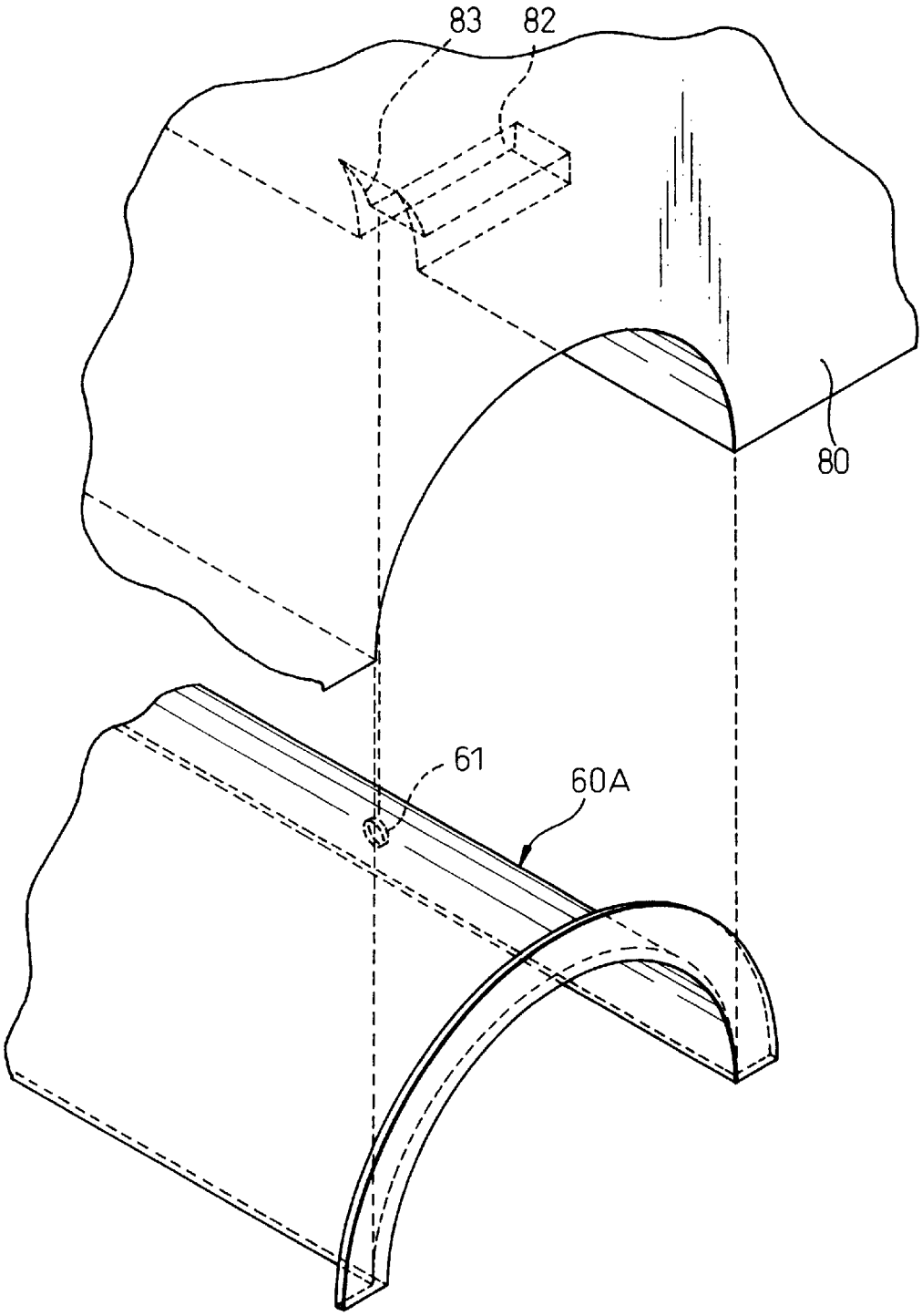
FIG. 5 is an exploded assembly diagram for explaining the oil path formed in a cam cap 80 and an upper metal bearing 60A.

As shown in FIG. 4, the advance oil path 71 in the cylinder head extends from the advance port 91*a* of the oil control valve 90 upward toward the cam cap 80 and protrudes above the upper surface 76 of the cylinder head 70. A groove 82 is formed in the lower surface 81 of the cam cap 80 in such a manner as to connect the advance oil path 71 in the cylinder head and the exterior of the upper metal bearing 60A. On the other hand, the upper metal bearing 60A is formed with a hole 61 having a diameter larger than the width of the annular advance oil path 53. An inclined oil path 83 is formed to establish communication between the hole 61 and the groove 82 in the lower surface 81 of the cam cap 80. FIG. 5 is an exploded assembly diagram of the upper metal bearing 60A and the cam cap 80 to facilitate the understanding of the above-mentioned configuration.

The retard oil path 72 in the cylinder head, on the other hand, extends from the retard port 91*b* of the oil control valve 90 toward the cam cap 80 but, after being curved midway, reaches an outer opening 72*a* of the lower metal bearing 60B.

Figure 6:
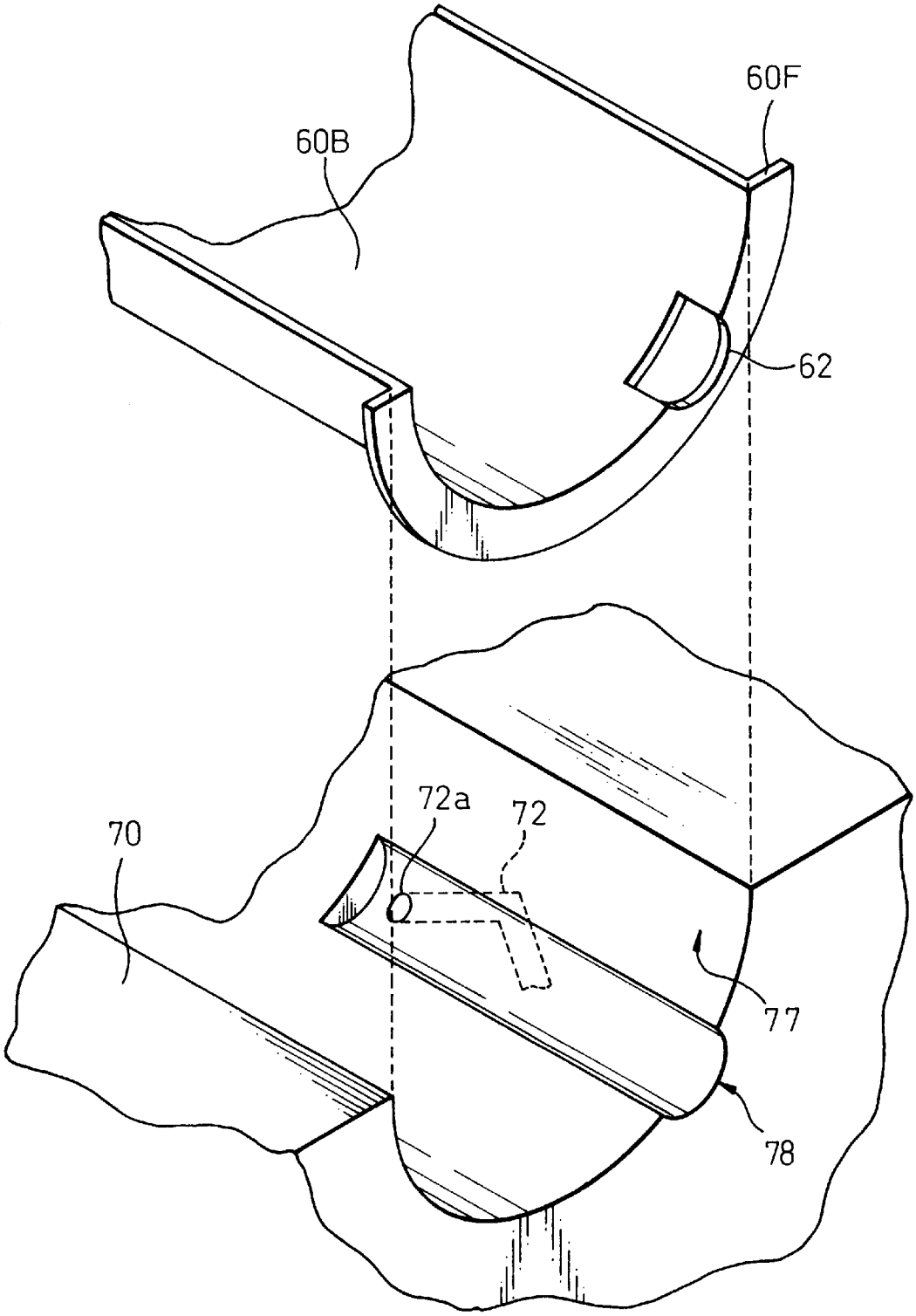
FIG. 6 is an exploded assembly diagram for explaining the oil path formed in a cylinder head and a lower metal bearing 60B.

Referring to the exploded assembly diagram of FIG. 6 showing the structure of the lower metal bearing 60B and the cylinder head 70, a groove 78 having a crescent-shaped section and a width larger than the diameter of the opening 72*a* is formed toward the axial end from the opening 72*a* in a receptacle 77 having a semicircular section of the cylinder head 70 for receiving the lower bearing metal 60B.

The lower metal bearing 60B, on the other hand, is formed with a notch 62 at a corner thereof from which a flange 60F rises. The notch as viewed from the axial direction is at least larger than the crescent-shaped section of the groove 78. The width of the notch as viewed from the direction perpendicular to the axis, on the other hand, is larger than the width of the annular retard oil path 54 of the camshaft 50 inscribed in this portion.

An independent part having the same function can be provided on the bearing metal in place of the flange.

In this way, the working oil for advance passes from the advance port 91*a* of the oil control valve 90 through the oil path 71 in the cylinder head, the groove 82 of the cam cap 80, the inclined oil path 83 and the hole 61 of the upper metal bearing 60A, and reaches the annular advance oil path 53 of the camshaft 50. Further, the working oil enters the advance oil path 55 in the camshaft by way of the short communication oil path 55*a* from the annular advance oil path 53, proceeds toward the axial end, reaches the central oil chamber 44 through the inclined oil path 45 of the rotor 40, and further through a distribution oil path 46, is distributed to each advance oil chamber 110.

The working oil for retardation, on the other hand, advances from the retard port 91*b* of the oil control valve 90 to the oil path 72 in the cylinder head and enters the oil path 79 formed between the groove 78 having a crescent-shaped section and the back of the lower metal bearing 60B, and proceeds toward the axial end, and through the notch 62 formed at a corner of the axial end of the lower bearing metal 60B, reaches the annular retard oil path 54 of the camshaft 50. From the annular retard oil path 54 through the short communication path 56*a*, the working oil enters the retard oil path 56 in the camshaft and advances toward the axial end, and through the short communication path 56*b*, reaches the annular retard oil path 57 at the axial end. From there, the working oil enters the inclined distribution oil path 12 through the annular oil path 11 formed in the gear 10 in opposed relation to the annular retard path 57 at the axial end, and then is distributed to each retard oil chamber 120.

In the prior art lacking the metal bearing, the positions of the two oil paths in the cylinder head are required not to overlap in the axial direction. According to this invention, in contrast, as shown in FIG. 1, the two paths in axial direction in the cylinder head can be arranged in an overlapped relationship, and the distance between the two annular oil paths is also set to a required minimum. As a result, an increase in the axial length of the engine is suppressed.

The working oil supplied for retardation follows a route where it is more liable to leak from between the flange of each metal bearing and the outer flange 51 of the cam than the working oil supplied for advance that follows another route.

Now, the control of the valve characteristics control apparatus 100 having the above-mentioned configuration will be described with reference to FIG. 4. This control operation is performed in such a manner that the valve characteristic corresponding to the operating conditions, i.e. the rotational phase difference of the camshaft 50 with respect to the crankshaft is determined and, by feedback control through the oil control valve 90, the actual required value of the phase difference of the camshaft 50 is obtained.

This control operation is performed by the ECU 200, which is a digital computer including an input interface 210, a central processing unit (CPU) 220, a random access memory (RAM) 230, a read-only memory (ROM) 240 and an output interface 250 connected to each other.

The input interface 210 of the ECU 200 is supplied with a signal from each sensor as required for the control operation.

First, the signal is applied from a crank position sensor 211. The crank position sensor 211, the detailed structure of which is not described, has an electromagnetic pickup arranged in proximity to a plurality of protrusions of a signal generating disk mounted on the crankshaft, so that a signal voltage is generated by the electromagnetic pickup each time a protrusion is passed. The protrusions of the signal generating disk are arranged at intervals of 10 degrees, and there are a total of 34 protrusions since two are missing. Each protrusion-free portion is located at a predetermined angular position with respect to the top dead center of the first cylinder, for example, and therefore the top dead center can be determined accurately based on the signal generated from the protrusion-free portion. The signals generated at intervals of ten degrees are further divided in frequency thereby to accurately determine the crank angle from the top dead center as of the measurement.

A cam angle sensor 212 has an electromagnetic pickup in proximity to a signal generating protrusion formed at an appropriate point on the camshaft 50, so that a signal voltage is generated each time the protrusion passes by the electromagnetic pickup. This protrusion is adapted to generate a signal once for each rotation of the camshaft 50, i.e. for each two rotations of the crankshaft. The protrusion is arranged, for example, to generate a signal at the maximum lift of the camshaft of the first cylinder.

An intake pipe pressure sensor 213 detects the intake pipe pressure PM as a load.

These signals are converted by the input interface 210 into a form suitable for arithmetic operation at the CPU 220, and applied to the CPU 220.

The CPU 220 performs the following operation for controlling the valve timing.

First, the present phase of the camshaft is determined based on the signal from the crank position sensor 211 and the cam angle sensor 212. As a parameter indicating this phase, the crank angle is calculated for the period from the compression top dead center of the first cylinder to the time when the cam angle sensor generates a signal, i.e. to the time point of maximum lift of the cam rise of the first cylinder. The compression top dead center is a point where a predetermined crank angle is passed from the time when the crank position sensor generates a signal of the protrusion-free portion.

Also, based on the signal from the crank position sensor 211, the engine speed NE is calculated. The target phase of the camshaft corresponding to the operating conditions defined by the intake pipe pressure PM detected by the intake pipe pressure sensor 213 and the engine speed NE is read from the map stored in advance in the ROM 240.

Figure 7:
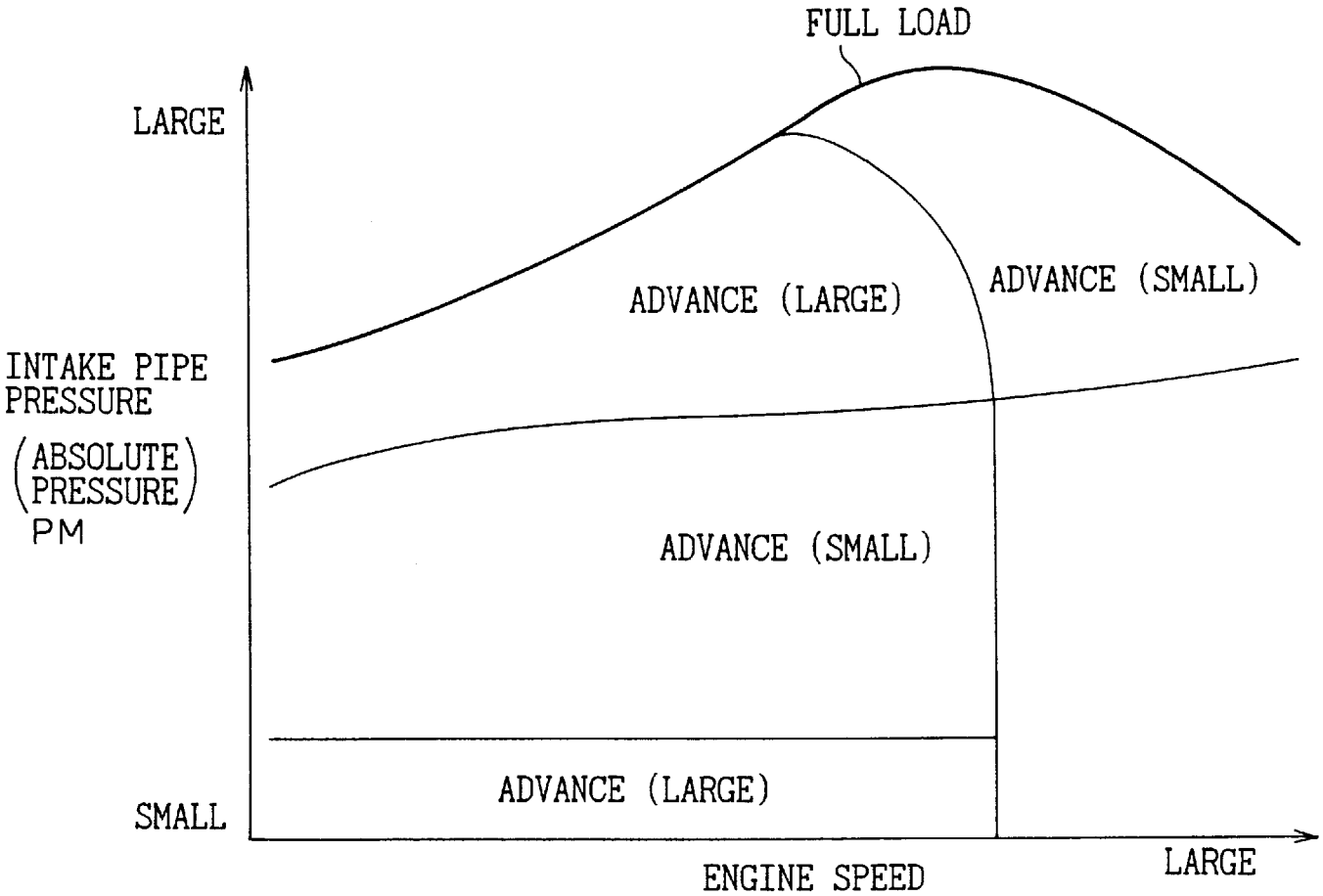
FIG. 7 is a map showing the phase of an intake cam with respect to the operating conditions.

FIG. 7 shows the phase of the intake camshaft with respect to the crankshaft corresponding to the operating conditions stored in the map. Under a light load, the combustion stability is given priority and the timing is retarded to the maximum in order to reduce the overlap. With the increase in load, the timing is advanced for a larger overlap to enhance the internal EGR rate to eliminate the pumping loss and improve both the power consumption and emission. Under a heavy load at high engine speed, the timing of closing the intake valve is somewhat advanced to improve the volumetric efficiency.

In the case where the actual phase measurement of the camshaft lags behind the target phase value of the shaft determined from the map, a command for sending an exciting current of the 100% duty cycle is issued to the electromagnetic solenoid 92 of the oil control valve 90, and the working oil is induced into the advance oil chamber 110 of the valve timing control unit 100. In this way, the phase of the camshaft is advanced to approach the target phase. In the case where the actual camshaft phase measurement leads the target phase value of the camshaft determined from the map, on the other than, a command is issued for demagnetizing the electromagnetic solenoid 92 of the oil control valve 90, so that the working oil may flow in the retard oil chamber 120 of the valve timing control unit 90, thus delaying the phase of the camshaft toward the target phase. Once the camshaft phase comes to coincide with the target value, the exciting current of an intermediate duty cycle is sent to hold the particular phase.

Figure 8:
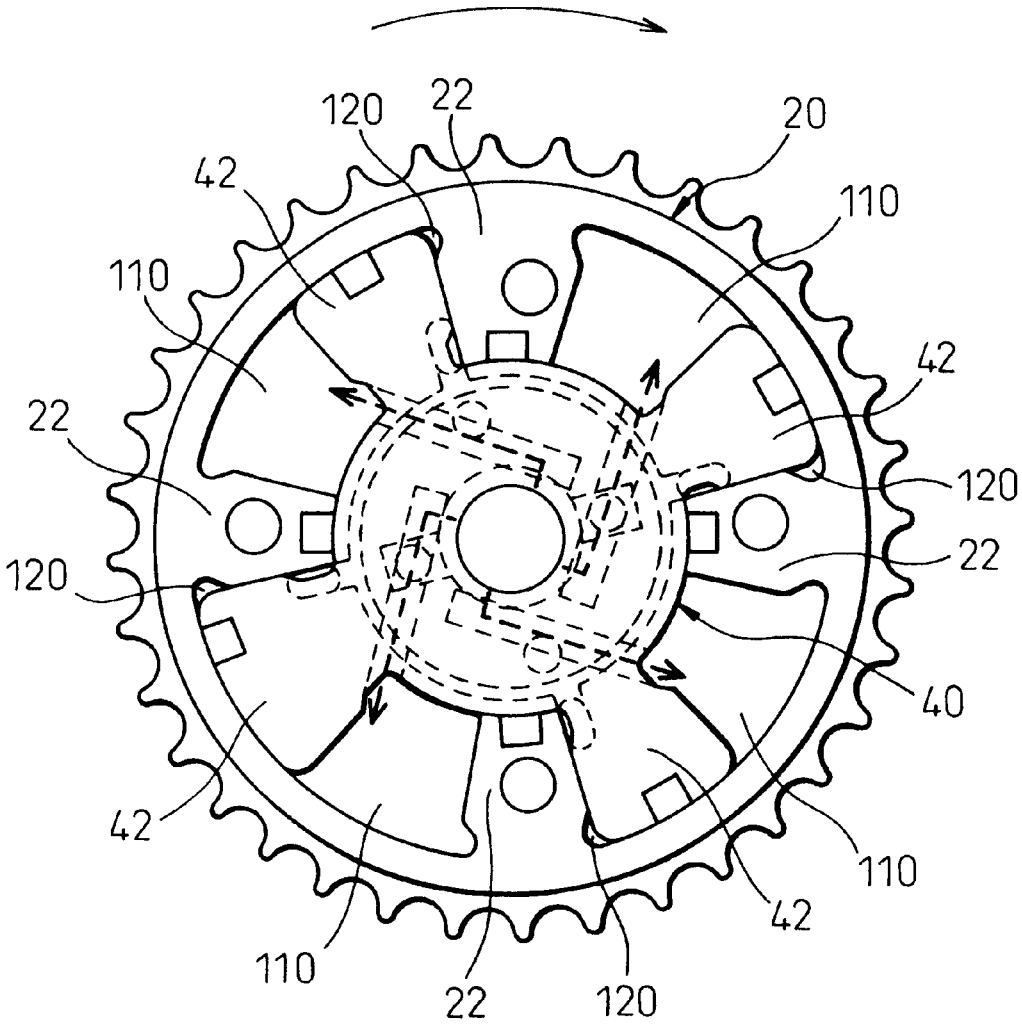
FIG. 8 shows relative positions of a valve housing 20 and a rotor 40 of a valve characteristic control apparatus 100 when the phase of the camshaft is advanced the most.
Figure 9:
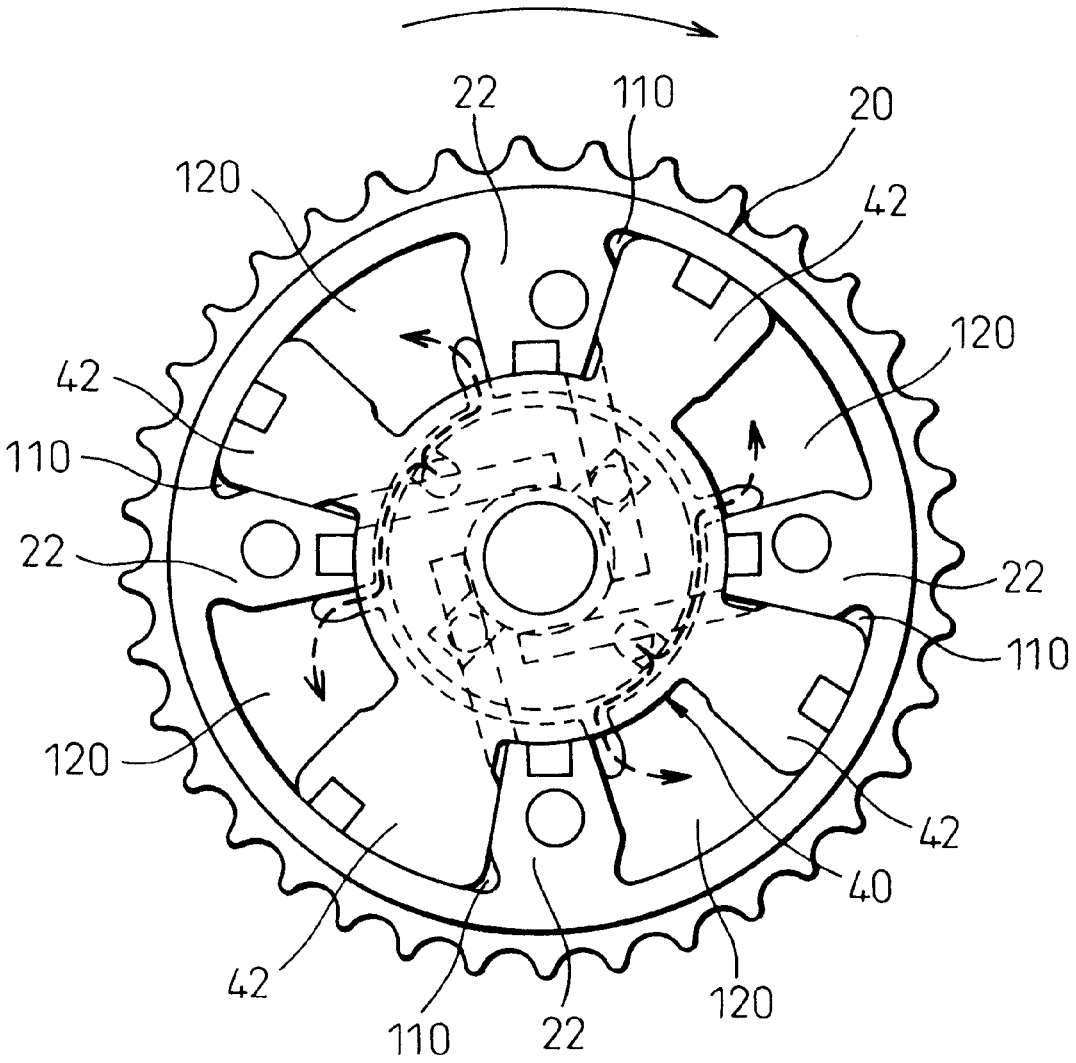
FIG. 9 shows relative positions of a valve housing 20 and a rotor 40 of a valve characteristics control apparatus 100 when the phase of the camshaft is retarded the most.
Figure 10:
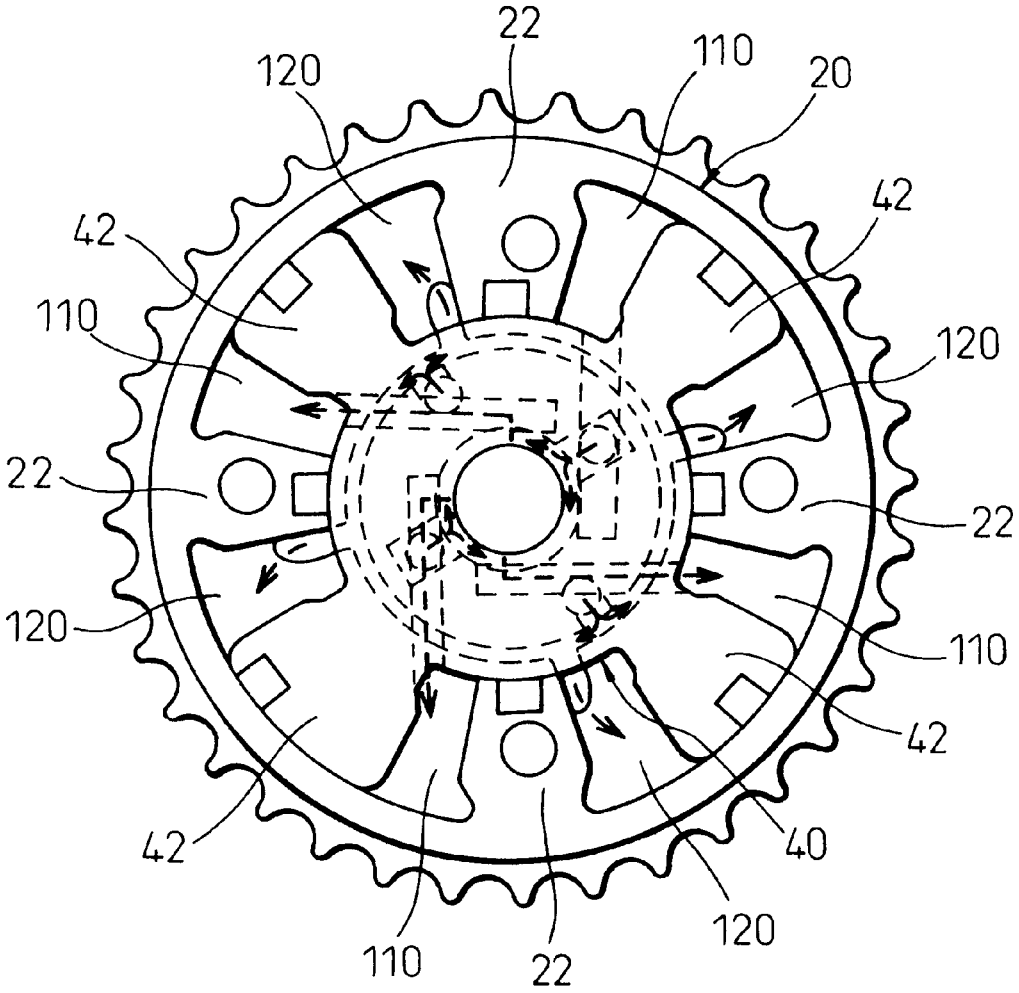
FIG. 10 shows relative positions of a valve housing 20 and a rotor 40 of a valve characteristics control apparatus 100 when the phase of the camshaft is between the most advanced point and the most retarded point.

FIGS. 8, 9 and 10 show relative positions between the vanes 42 of the rotor 40 and the inner protrusions 33 of the valve housing 20 of the valve characteristic control unit 100 when the camshaft phase is most advanced, most retarded and intermediate, respectively.

In each of FIGS. 8, 9 and 10, the housing 20 and the rotor 40 driven by the housing 20 are rotated clockwise as indicated by arrow. Also, as few reference numerals as possible are indicated to facilitate understanding.

First, assume that the valve operation phase is advanced to the maximum as shown in FIG. 8. The electromagnetic solenoid 92 of the oil control valve 90 is energized with a duty cycle of 100%, so that the working oil introduced as indicated by thick dashed arrow is filled up in the advance oil chamber 110, while the working oil is discharged from the retard oil chamber 120 in its entirety. Then, the duty cycle is changed and held to an intermediate value.

Assume, on the other hand, that the valve operation phase is retarded to the maximum as shown in FIG. 9. The electromagnetic solenoid 92 of the oil control valve 90 is demagnetized, and the working oil introduced as shown by thick dashed arrow is filled up in the retard oil chamber 120, while the working oil is discharged from the advance oil chamber 110 in its entirety. Then, the duty cycle is changed and held to its intermediate value.

It is not true that the oil control valve 90 opens the advance port 91*a* only when the electromagnetic solenoid 92 is energized with the duty cycle of 100% or opens the retard port 91*b* only with the duty cycle of 0% (deenergization). Instead, the advance port 91*a* begins to open gradually at a duty cycle lower than 100% or higher than 0% and reaches the maximum opening at the duty cycle of 100% or 0% (deenergization). The duty cycle, therefore, is not always required to be 100% or 0%. Rather, an attempt to maintain the duty cycle at 100% or 0% would undesirably consumes considerable time before reaching a target phase due to an overshoot. In view of this, according to this embodiment, the duty cycle is changed in accordance with the difference with the target phase, though this is not described in detail here.

Assume that the valve operation phase is set intermediate as shown in FIG. 10. For attaining the intermediate phase from a retarded state, the working oil is introduced to the advance oil chamber 110 while the working oil is discharged from the retard oil chamber 120, as in the former case described above, and the desired state reached is held. For attaining the intermediate phase from an advanced state, on the other hand, the working oil is introduced into the retard oil chamber 120 and the working oil is drained from the advance oil chamber 110, as in the latter case described above, and the desired state reached is held.

The working oil is required to be introduced into the advance oil chamber 110 against the tendency of the inner protrusions 22 of the housing 20 to approach the vanes 42 of the rotor 40, and therefore a high oil pressure is required. The introduction of the working oil into the retard oil chamber 120, in contrast, helps the inner protrusions 22 of the housing 20 approach the vanes 42 of the rotor 40 through the gear 10 under the force of the crankshaft, and therefore does not requires a high oil pressure.

This is the reason why the working oil for retardation not requiring a high oil pressure is guided to follow the route highly liable to leak, while the working oil for advance, requiring a high pressure, follows the route where the working oil is less liable to leak.

The above-mentioned first embodiment is applicable to the camshaft for driving the intake valve. Advancing the phase of the camshaft, therefore, is equivalent to lengthening the overlap period during which both the intake valve that has opened early and the exhaust valve are open. Retarding the camshaft phase, in contrast, is tantamount to shortening the overlap period.

A shortened overlap period reduces the spitting of the mixture gas toward the intake pipe and thus reduces the internal EGR for a stable engine combustion.

An increased overlap, in contrast, increases the internal EGR and the resulting reduced pumping loss improves the fuel consumption.

Consequently, under a light load and at the time of idling requiring combustion stability, the camshaft phase is retarded, while under a heavy load, the camshaft phase is advanced.

The rate of change from heavy to light load is higher than the rate of change from light to heavy load. Therefore, the operation of retarding the camshaft phase requires a higher rate.

According to the first embodiment, comparison between advance and retard operations shows that the retard operation is quicker as the inner protrusions 22 of the housing 20 try to approach the vanes 42 of the rotor 40 with a larger force of the crankshaft through the gear 10.

The selection of the advance and retard oil chambers according to the first embodiment, therefore, meets these requirements.

Now, consider the case in which a valve characteristic control apparatus of vane type, similar to the first embodiment, is applied to the exhaust valve. For the overlap to be reduced, the camshaft for the exhaust valve is required to be advanced, which requires a large force generated by the oil chamber. For enlarging the overlap, on the other hand, the camshaft phase is retarded, and therefore a large force is not required to be generated by the oil chamber.

The overlap is required to be reduced as quickly as possible. The overlap is reduced, therefore, by the working oil passing through the small-leakage route where the annular oil path is covered by the metal bearing.

Now, as a second embodiment, consider the case in which a helical gear is interposed between the driving pulley and the camshaft and is driven by the working oil passing through the two annular oil paths as in the first embodiment thereby to displace the camshaft.

Figure 11:
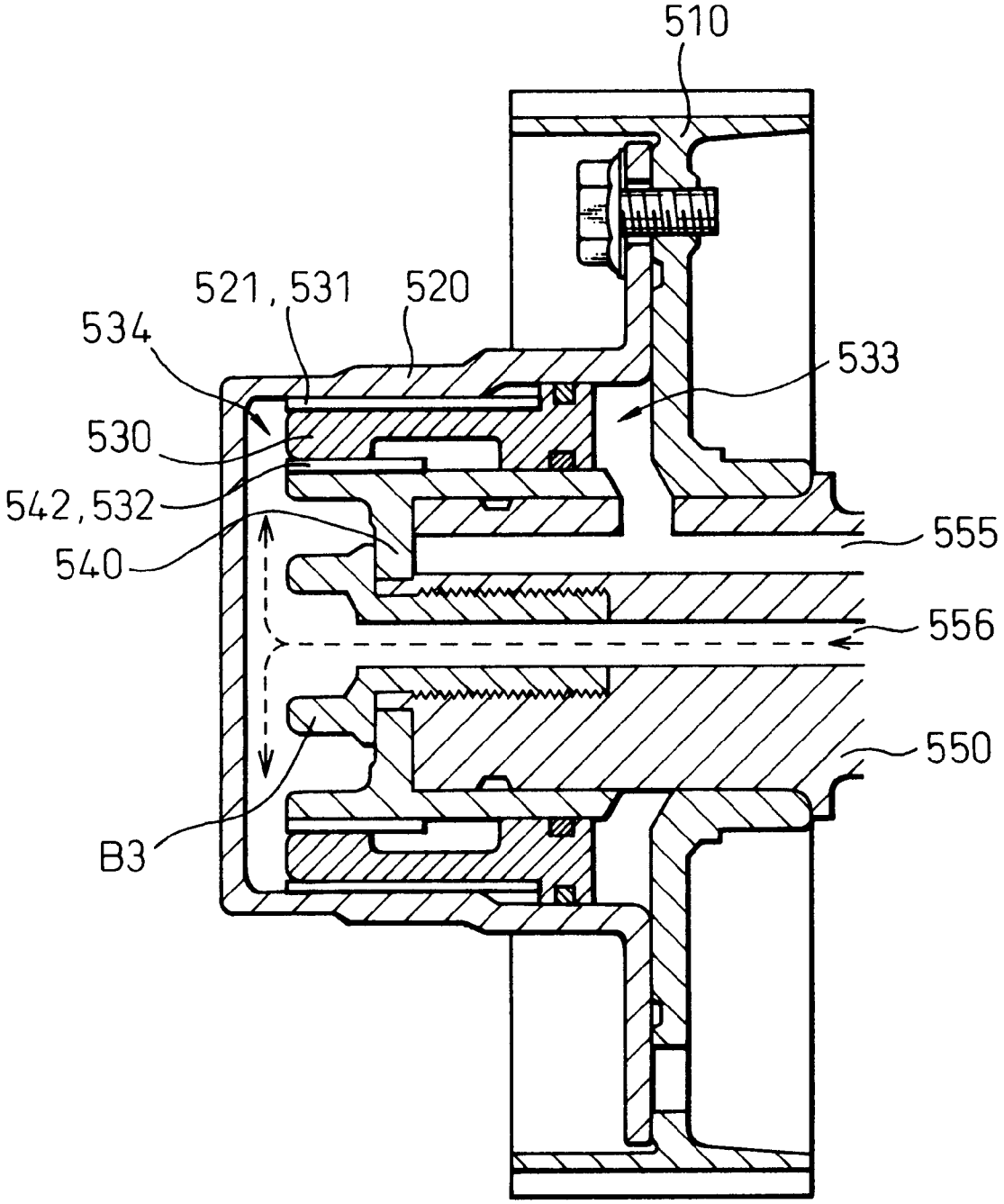
FIG. 11 is a diagram for explaining the structure according to a second embodiment.

FIG. 11 is a diagram showing a structure of the second embodiment. In FIG. 11, numeral 510 designates a pulley driven by the crankshaft (not shown). A housing 520 is fixed on the pulley 510. Numeral 550, on the other hand, designates a camshaft on which a piston receiving member 540 is fixed by a bolt B3.

Numeral 530 designates a piston. Helical splines 531 and 532 are formed on the outer and inner peripheries of the piston, respectively. The helical spline 531 on the outer periphery meshes with the helical spline 521 formed on the housing 520, while the helical spline 532 on the inner periphery meshes with the helical spline 542 formed on the piston receiving member 540.

The working oil is supplied through the oil path 555 to the oil chamber 533 axially inward of the piston 530. Also, the working oil is supplied through the oil path 556 to the oil chamber 534 axially outward. Thus, the phase of the camshaft 550 with respect to the pulley 510 can be changed. The force exerted when the phase of the camshaft 550 with respect to the pulley 510 is changed is derived solely from the working oil supplied to the oil chambers 533 and 534. The pressure-receiving surfaces of the piston 550, therefore, have a substantially the same area.

In the second embodiment, unlike the first embodiment, the force required of the piston for an advance operation is equal to the force required of the piston for a retard operation.

The route from the oil control valve to the oil paths 555, 556, though not shown, is the same as the route up to the first oil path 55 and the second oil path in the cam according to the first embodiment. The working oil that has reached the oil path 555 leaks less midway and activates the piston 530 quicker with a quicker displacement of the camshaft. When the oil chamber 533 is supplied with the working oil, therefore, the overlap is reduced.

In both the first and second embodiments described above, the camshaft phase is shifted without changing the valve open period. The present invention, however, is applicable also to the case in which the valve open time is changed by displacing the camshaft in axial direction.

According to this invention, there is provided a valve characteristic control apparatus in which the axial length of the engine is not increased and the weight of the engine with the valve characteristic control apparatus mounted thereon is not increased nor is the mountability on the vehicle thereof deteriorated.

I claim:

1. A valve characteristics control apparatus for controlling the operational characteristics of the valves of an internal combustion engine opened and closed by a camshaft, comprising:

a first oil chamber for generating a force for displacing the camshaft in a first direction when supplied with the working oil;

a second oil chamber for generating a force for displacing the camshaft in a second direction opposite to the first direction when supplied with the working oil;

a working oil supply control valve arranged in a support member for supporting the camshaft for controlling the working oil supplied to the first oil chamber and the second oil chamber, the working oil being discharged from the second oil chamber when supplied to the first oil chamber, the working oil being discharged from the first oil chamber when supplied to the second oil chamber;

a first oil path for leading the working oil from the working oil supply control valve to the first oil chamber and a second oil path for leading the working oil from the working oil supply control valve to the second oil chamber wherein the firet oil path and the second oil path include an annular first oil path and an annular second oil path formed in the camshaft and a sliding portion of the support member for supporting the camshaft, a first in-camshaft oil path formed in the camshaft for connecting the first oil chamber, a second in-camshaft oil path formed in the camshaft for connecting the annular second oil path and the second oil chamber, a first in-support member oil path formed in the support member for connecting the annular first oil path and the working oil supply control valve, and a second in-support member oil path formed in the support member for connecting the annular second oil path and the working oil supply control valve; and a metal bearing arranged between the annular oil paths and cam-side openings of the in-support member oil paths, and at least one of the in-support oil paths reaches a back of the metal bearing from the working oil supply control valve, extends in an axial direction along the back of the metal bearing, comes to communicate with a corresponding annular oil path at a different axial position from the reached point of the back.

2. A valve characteristics control apparatus according to claim 1, wherein one of the two annular oil paths is arranged in an area covered with the metal bearing, the other annular oil path being arranged in an area not covered with the metal bearing, wherein the annular oil path arranged in an area covered with the metal bearing communicates, by way of a through hole formed in the surface of the metal bearing supporting the camshaft, with a corresponding in-support member oil path reaching the back of the metal bearing from the working oil supply control valve, at the same axial position as said reached point at the back, and wherein the annular oil path arranged in an area not covered with the metal bearing is formed at an end of the metal bearing and communicates, through a bypass formed along an end of the metal bearing, with a back oil path connected to a corresponding in-support member oil path.

3. A valve characteristic control apparatus according to claim 2, wherein said metal bearing is divided into two parts, one part being formed with said through hole, the other part being formed with said bypass.

4. A valve characteristics control apparatus according to claim 2, wherein the in-support member oil path corresponding to the annular oil path formed in the area covered with the metal bearing, after reaching the back of said metal bearing, reaches said through hole by way of the back oil path extending in the peripheral direction along the back of said metal bearing.

5. A valve characteristics control apparatus according to claim 2, wherein said metal bearing includes a flange arranged at an end thereof, and said bypass is formed through the base of said flange.

6. A valve characteristic control apparatus according to claim 2, wherein the rotational phase of the camshaft with respect to the crankshaft is changed by supplying the working oil to said first oil chamber and said second oil chamber, the valve open period is not changed but shifted thereby to change the valve characteristics most suitably according to the prevailing operating conditions.

7. A valve characteristic control apparatus according to claim 6, wherein, in the case where the force required of a first oil chamber to displace said camshaft in the advance direction is different in magnitude from the force required of a second oil chamber to displace the camshaft in the retard direction, the working oil passing through the annular oil path formed in the area covered by said bearing metal is supplied to a selected one of said first and second oil chambers that requires a larger force.

8. A valve characteristic control apparatus according to claim 2, wherein, in the case where the valve overlap is increased or decreased by displacing the camshaft and the force required of a first oil chamber to decrease the valve overlap is not smaller than the force required of a second oil chamber to increase the valve overlap, the working oil passed through the annular oil path formed in the area covered with the metal bearing is supplied to a selected one of said first and second oil chambers that displaces the camshaft in the direction of decreasing the overlap.

* * * * *

UNITED STATES PATENT AND TRADEMARK OFFICE

CERTIFICATE OF CORRECTION

PATENT NO. : 6,026,772
DATED : February 22, 2000
INVENTOR(S) : Takeo SHIRABE

It is certified that error appears in the above-identified patent and that said Letters Patent is hereby corrected as shown below:

Column 10, line 63, change "firet" to --first--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*